US005362169A

United States Patent [19]

Hamamoto et al.

[11] Patent Number: 5,362,169

[45] Date of Patent: Nov. 8, 1994

[54] APPLICATOR HAVING CAP WHICH PRESSURIZES INNER SPACE

[75] Inventors: Hirofumi Hamamoto; Hideshi Okamoto, both of Tokyo, Japan

[73] Assignee: Sailor Pen Co., Ltd., Tokyo, Japan

[21] Appl. No.: 138,352

[22] Filed: Oct. 18, 1993

[30] Foreign Application Priority Data

Oct. 30, 1992 [JP] Japan ..... 4-081060[U]
Oct. 30, 1992 [JP] Japan ..... 4-081061[U]

[51] Int. Cl.[5] ..... B43K 9/00; B43K 7/00

[52] U.S. Cl. ..... 401/213; 401/187; 401/188 A; 401/247

[58] Field of Search ..... 401/213, 214, 188 R, 401/188 A, 187, 247

[56] References Cited

U.S. PATENT DOCUMENTS 1,848,358 3/1932 Kratz ..... 401/187
3,819,285 6/1974 Andrews et al. ..... 401/214 X

FOREIGN PATENT DOCUMENTS 1044198 11/1953 France ..... 401/213
403127 4/1943 Italy ..... 401/187
270136 11/1950 Switzerland ..... 401/213

*Primary Examiner*—Steven A. Bratlie
*Attorney, Agent, or Firm*—Frishauf, Holtz, Goodman & Woodward

[57] ABSTRACT

Disclosed is an applicator in which the air within the inner barrel of a cap is designed to enter into the fluid tank of the applicator to increase the internal pressure of the fluid tank in the process that the cap is engaged with the body of the applicator, so that the fluid tank need not be pressed between the fingers for application of the fluid to be applied. The cap has a valve member provided with a pushing piece disposed in the inner barrel thereof, and the application ball is designed to retract from the caulked front edge of the tip when the application ball is abutted against the pushing piece of the valve member in the process that the cap is engaged with the body of the applicator, whereas the application ball is designed to disengage from the pushing piece of the tip and resume contact with the caulked front edge of the tip when the cap is fully engaged with the body of the applicator.

3 Claims, 5 Drawing Sheets

APPLICATOR HAVING CAP WHICH PRESSURIZES INNER SPACE

BACKGROUND OF THE INVENTION

This invention relates to an applicator to which a highly viscous fluid to be applied such as correction fluid and make-up fluid is charged.

In an applicator having a spherical form of application member (application ball), a tip is attached to the neck formed at one end of a fluid tank which is filled with a fluid to be applied, and the tip bears rotatably therein an application ball in such a way that the application ball may partly be exposed from the front edge thereof like a ball point pen. The application ball is resiliently urged by a spring so as to bring the application ball into intimate contact with the caulked front edge of the tip, when the applicator is not used, whereby to allow the application ball and the front edge of the tip to form a valve structure, preventing the fluid to be applied from being discharged.

When the application ball is pressed against a surface to be treated for application of the fluid, the application ball retracts against the resilience of the spring to provide a clearance between the application ball and the front edge of the tip, allowing the fluid deposited to the hidden portion of the application ball locating within the tip to be delivered through the clearance to the outside of the tip for application as the application ball is rolled. However, since the fluid has high viscosity, the fluid cannot as such be fed fully to the surface of the application ball. Accordingly, the fluid tank is molded by blowing using a flexible material to be squeezable, and the fluid tank is pressed between the fingers to increase the internal pressure of the fluid tank for application of the fluid to allow the fluid to be fed out to the exposed surface of the application ball with the aid of the thus increased pressure.

Thus, the prior art applicator suffers inconveniences that the handling thereof is troublesome since the fluid tank must be pressed between the fingers to increase the internal pressure of the tank for application of the fluid, and besides the production cost elevates since the fluid tank must be molded by blowing using a flexible material.

Therefore, if a cap is designed to be able to be push fitted to the neck of the fluid tank with the front edge of the tip being sealed with the inner barrel of a cap, in the process that the cap is engaged with the neck, to reduce the volume of the sealed space defined within the inner barrel, the internal pressure of the inner barrel can be increased. Accordingly, the air in the inner barrel intrudes into the fluid tank to increase the internal pressure of the fluid tank, and thus the fluid tank need not be pressed between the fingers for application of the fluid to be applied.

However, since the application ball is resiliently urged by the spring, the application ball must be retracted against the resilience of the spring so as to allow the air in the inner barrel to enter into the fluid tank. Accordingly, the internal pressure of the inner barrel must sufficiently be increased. In other words, while the push fitting distance of the cap in the state where the inner barrel thereof is sealing the front edge of the tip must be increased, the longer the inner barrel of the cap becomes, the more difficult and convenient becomes the pressurizing operation.

OBJECT AND SUMMARY OF THE INVENTION

Under such circumstances, the present invention is directed to provide an applicator at a low production cost which allows easy entry of the air within the inner barrel of the cap into the fluid tank, when the cap is engaged with the neck, to increase the internal pressure of the fluid tank and which requires no pressing of the fluid tank for application.

In order to attain the intended objects, the applicator according to the present invention has an application ball retained rotatably in a tip such that the application ball may partly be exposed from the front edge of the tip, a spring for resiliently urging the application ball to be abutted against the caulked front edge of the tip, a fluid tank in which a highly viscous film-forming fluid to be applied is contained and a neck formed contiguous to said fluid tank in which the tip is held, the outer circumference of the inner barrel of the neck being in intimate contact with the inner circumference of the cap so as to seal the tip; wherein the cap has a valve member provided with a pushing piece disposed in an inner barrel thereof; the application ball is designed to retract from the caulked front edge of the tip when the application ball is abutted against the pushing piece of the valve member in the process that the cap is engaged with the neck, whereas the front edge of the tip is disengaged from the pressing piece to allow the application ball to resume contact with the caulked front edge of the tip when the cap is fully engaged with the neck.

More specifically, while the internal pressure of the inner barrel is increased in the process that the cap is engaged with the neck, the application ball is abutted against the pushing piece of the valve member, so that the application ball is retracted from the caulked front edge of the tip by the repulsion of the pushing piece to open the valve mechanism. The air pressurized within the inner barrel can thus readily enter into the fluid tank to increase the internal pressure of the fluid tank. When the cap is fully engaged with the neck, the front edge of the tip disengages from the pushing piece, and the application ball resumes contact with the caulked front edge of the tip to close the valve mechanism and maintain the increased internal pressure within the fluid tank. Accordingly, the fluid tank need not be pressed between the fingers for application of the fluid contained therein, and besides the fluid tank need not be molded by blowing using a flexible material but can be injection molded using an ordinary hard synthetic resin, so that the applicator can be produced at a low cost.

BRIEF DESCRIPTION OF THE DRAWINGS

The features of this invention that are believed to be novel are set forth with particularity in the appended claims. The invention, together with the objects and advantages thereof, may best be understood by reference to the following description of the preferred embodiments taken in conjunction with the accompanying drawings in which:

DETAILED DESCRIPTION OF PREFERRED EMBODIMENTS

Figure 1:
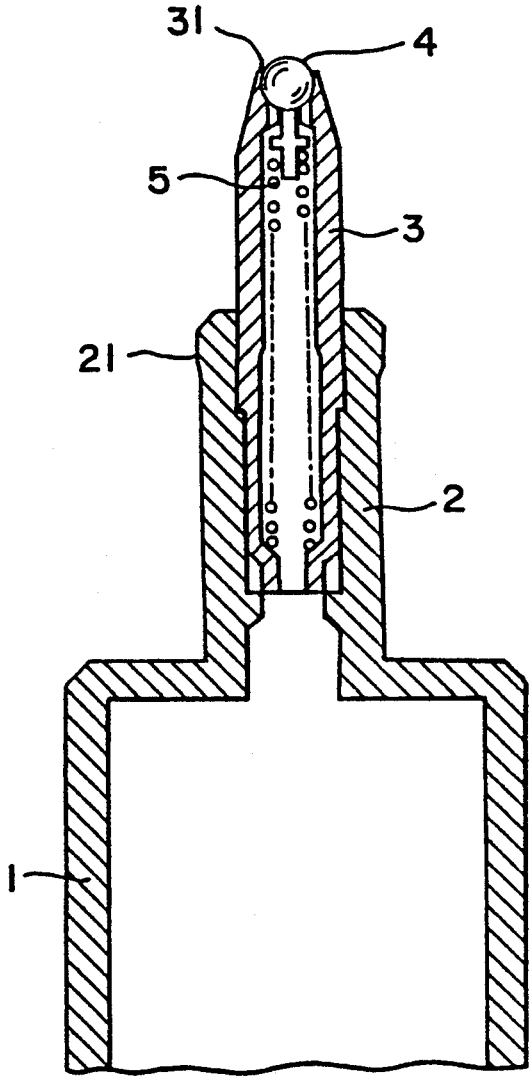
FIG. 1 shows a cross-sectional view of an applicator.

The present invention will now be described below specifically based on the embodiments shown in the attached drawings. In FIG. 1, a tip 3 is fitted in the front edge opening of a neck 2 having an annular ridge 21 formed along the circumference thereof. The tip 3 is made of stainless steel and has a bullet-like form. A ball housing is defined in the front end portion of the tip 3, which bears rotatably therein an application ball 4 comprising a 1.0 mm diameter super hard ball in such a way that the application ball 4 may partly be exposed from the front edge of the tip 3. Incidentally, the tip 3 may be made of a metallic pipe.

Figure 2:
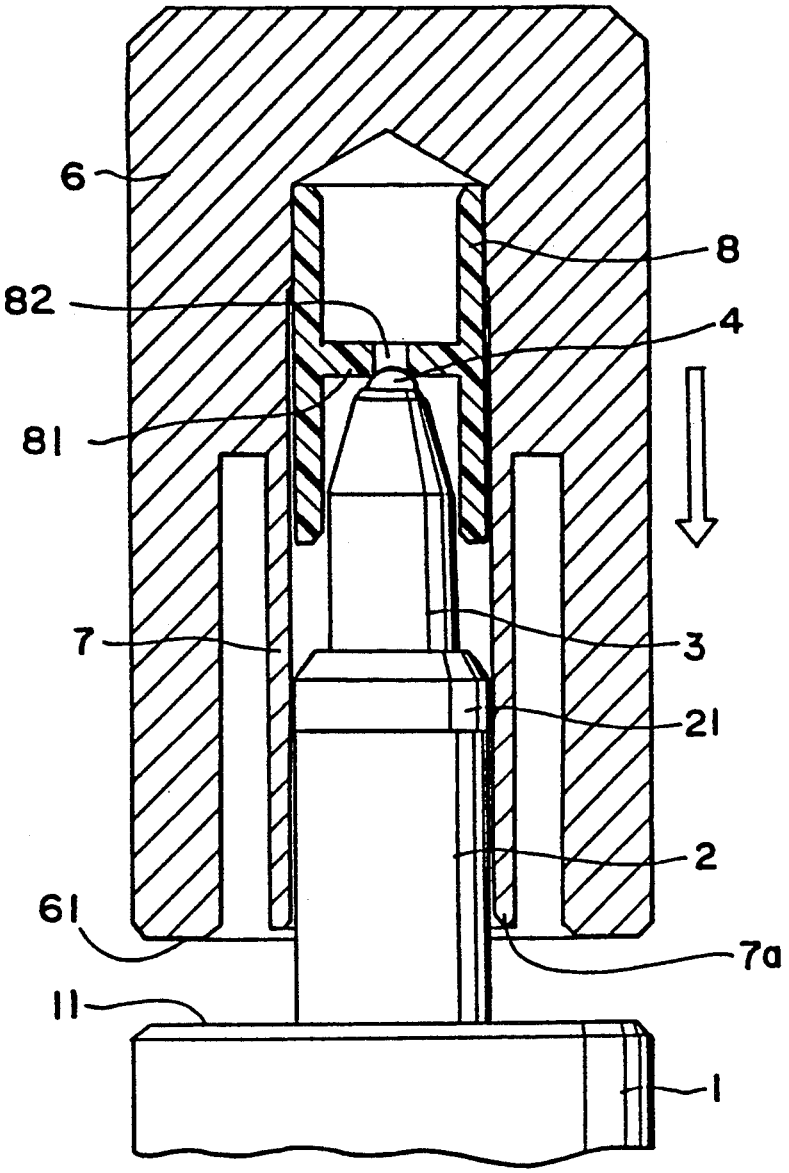
FIG. 2 shows an explanatory view where a cap according to a first embodiment of the invention is being engaged with the applicator.

A small spring 5 having a spring power of 40 g is disposed in the tip 3 and resiliently urges the application ball 4 to be in press contact with the caulked front edge 31 of the tip 3 and constitute a valve mechanism between the application ball 4 and the front edge 31 of the tip 3. The neck 2 is formed integrally with a fluid tank 1. The fluid tank 1 is injection molded using an ordinary hard synthetic resin which can be produced at a low production cost compared with those molded by blowing using flexible materials. A fluid to be applied, for example a correction fluid having a high film-forming property with a viscosity of 30 to 40 cps is charged in the fluid tank 1 to the cavities in the neck 2 and tip 3. A first embodiment of the invention will now be described referring to FIGS. 2 and 3. The cap 6 is molded using a synthetic resin and has an inner barrel 7 formed integrally therein, as shown in FIG. 2. A hermetically sealed space is defined in the inner barrel 7 by bringing the inner circumference at the edge 7*a* of the inner barrel 7 into intimate contact with the annular ridge 21 of the neck 2. The inner barrel 7 has a valve member 8 disposed therein. The valve member 8 is molded using a highly flexible material and has a cylindrical form. A diaphragm is formed at the middle of the valve member 8. The diaphragm has a center bore 82 having a diameter smaller than that of the application ball 4. Namely, the diaphragm having the center bore 82 constitutes an inward flange 81 which functions as a pushing piece.

Thus, the edge 7*a* of the inner barrel 7 is brought into intimate contact with the annular ridge 21 of the neck 2, in the process that the cap 6 is engaged with the neck 2, to provide a hermetically sealed space within the inner barrel 7. By pushing the cap 6 further in this state in the direction shown by the arrow, the inner circumference of the inner barrel 7 slides under intimate contact with the annular ridge 21 to reduce the volume of the sealed space in the inner barrel 7, and thus the air within the inner barrel 7 is pressurized. While the application ball is thus abutted against the inward flange 81, as shown in FIG. 2, the application ball 41 is forced to retract by the repulsion of the inward flange 81 if the cap is pushed further. Namely, a clearance is formed between the application ball 4 and the front edge 31 of the tip 3 to allow the air within the inner barrel 7 to inter into the fluid tank 1 and increase the internal pressure of the fluid tank 1.

Figure 3:
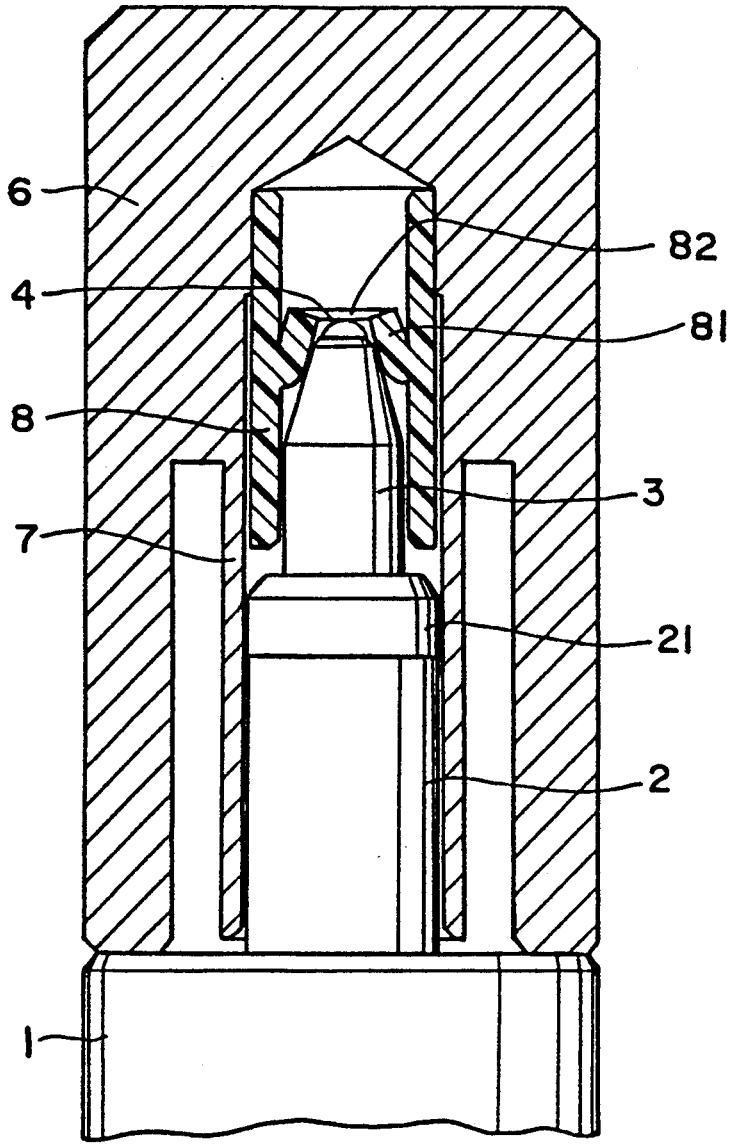
FIG. 3 shows an explanatory view where the cap according to the first embodiment of the invention is fully engaged with the applicator.

When the cap assuming the state shown in FIG. 2 is further pushed to allow the open end 61 of the cap 6 to abut against the front end face 11 of the fluid tank 1, the cap 6 is fully engaged with the neck 2, as shown in FIG. 3. In this state, the inward flange 81 is greatly flexed to allow the front edge of the tip 2 to intrude into the center bore 82, and the outer circumference at the front end portion of the tip 2 is brought into contact with the inward flange 81, where the application ball 4 is no more in contact with the inward flange 81. Accordingly, the application ball 4 resumes contact with the front edge 31 of the tip 3 with the aid of the resilience of the spring 5 to maintain the increased pressure in the fluid tank 1.

Figure 4:
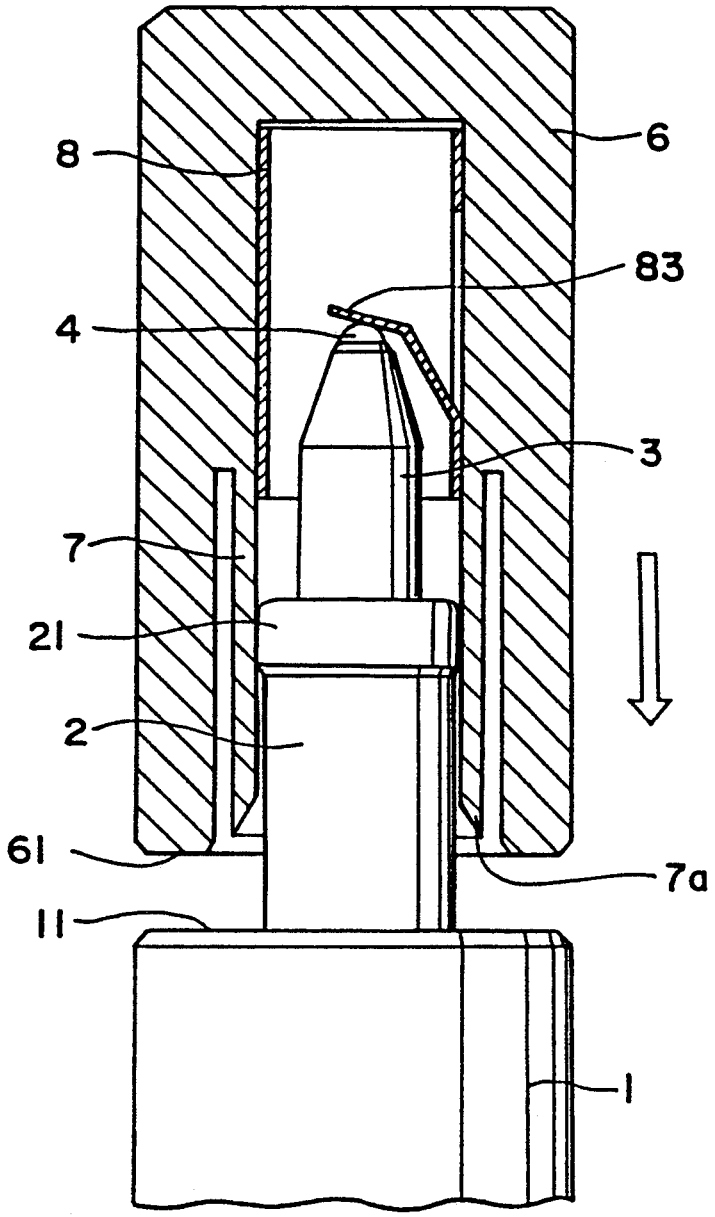
FIG. 4 shows an explanatory view where a cap according to a second embodiment of the invention is being engaged with the applicator.
Figure 5:
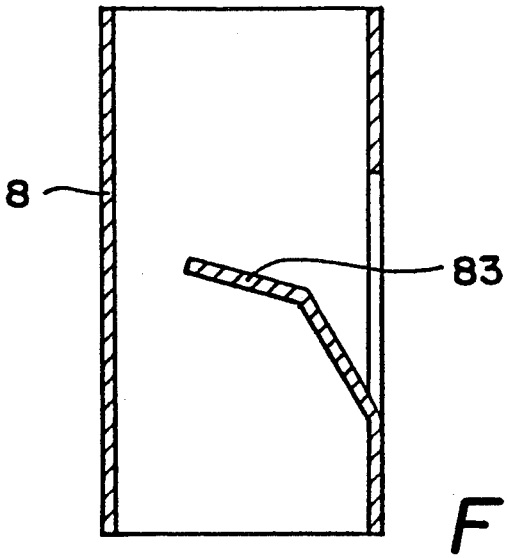
FIG. 5 shows a cross-sectional view of the valve member in the cap of the second embodiment.
Figure 6:
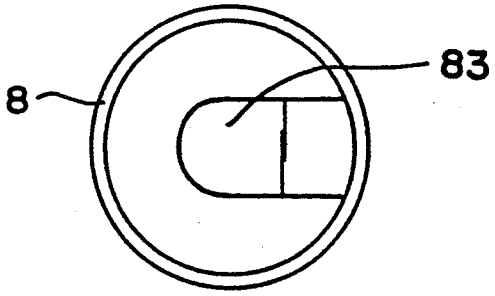
FIG. 6 shows a plan view of the valve member in the cap of the second embodiment.

Next, a second embodiment of the invention will be described referring to FIGS. 4 to 7. A valve member 8 disposed in an inner barrel 7 is molded using a highly elastic metal and has a cylindrical form. As shown in FIGS. 5 and 6, a tongue 83 is cut out from the side wall of the valve member 8 so as to protrude diagonally inward, and the tongue 83 thus formed serves as the pushing piece.

Thus, the edge 7*a* of the inner barrel 7 is brought into intimate contact with the annular ridge 21 of the neck 2, in the process that the cap 6 is engaged with the neck 2, to provide a hermetically sealed space within the inner barrel 7. By pushing the cap 6 further in this state in the direction shown by the arrow, the inner circumference of the inner barrel 7 slides under intimate contact with the annular ridge 21 to reduce the volume of the sealed space in the inner barrel 7, and thus the air within the inner barrel 7 is pressurized. While the application ball 4 is then abutted against the tongue 83, as shown in FIG. 4, the application ball 4 is forced to retract by the repulsion of the tongue 83 if the cap is pushed further. Namely, a clearance is formed between the application ball 4 and the front edge 31 of the tip 3 to allow the air within the inner barrel 7 to enter into the fluid tank 1 and increase the internal pressure of the fluid tank 1.

Figure 7:
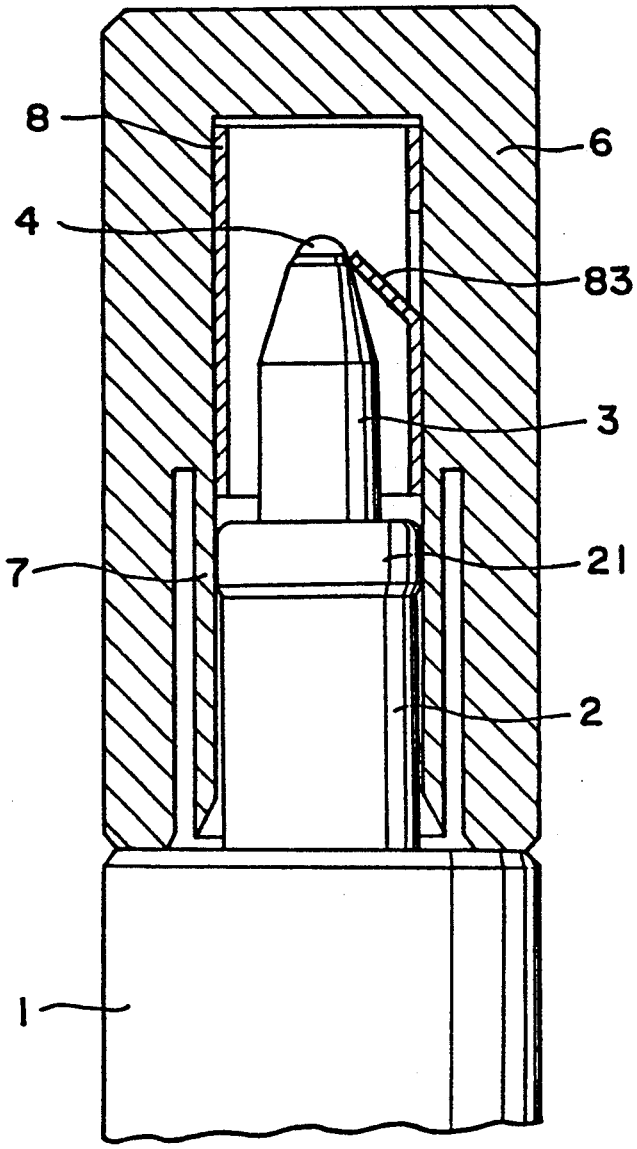
FIG. 7 shows an explanatory view where the cap according to the second embodiment is fully engaged with the applicator.

When the cap 6 assuming the state shown in FIG. 4 is further pushed to allow the open end 61 of the cap 6 to abut against the front end face 11 of the fluid tank 1, the cap 6 is fully engaged with the neck 2, as shown in FIG. 7. In this state, the tongue 83 is greatly flexed to be in contact with the circumference at the front end portion of the tip 2, where the application ball 4 is no more in contact with the tongue 83. Accordingly, the application ball 4 resumes contact with the front edge 31 of the tip 3 with the aid of the resilience of the spring 5 to maintain the increased pressure in the fluid tank 1.

When engagement of the cap 6 is completed as described above, the air within the inner barrel 7 readily enters into the fluid tank 1 and increases the internal pressure of the fluid tank 1 without increasing the internal pressure of the inner barrel 7 so much. Accordingly, when the fluid contained in the fluid tank 1 is to be applied after removing the cap 6, the fluid can be fed fully to the application ball 4. Namely, the fluid tank 1 need not be pressed between the fingers, and the fluid can securely be applied to the surface to be treated in the same manner as writing with a ball point pen.

As has been described heretofore, in the applicator according to the present invention, since the application ball is designed to be abutted against the pushing piece of the valve member, in the process that the cap is engaged with the neck, to retract from the caulked front edge of the tip by the repulsion of the pushing piece and open the valve mechanism, the air pressurized within the inner barrel can readily enter into the fluid tank to increase the internal pressure of the fluid tank. Accordingly, the fluid tank need not be pressed between the fingers for application of the fluid contained therein, and besides the fluid tank need not be molded by blowing using a flexible material but can be injection molded using an ordinary hard synthetic resin, so that the applicator can be produced at a low cost.

Although two embodiments of the present invention have been described herein, it should be apparent to those skilled in the art that the present invention may be embodied in many other specific forms without departing from the spirit or scope of the invention.

What is claimed is:

1. An applicator comprising:

fluid tank means for containing a highly viscous film-forming fluid to be applied;

a neck formed contiguous with said fluid tank means and having an outer circumference;

a tip having a caulked front edge and held within said neck;

an application ball rotatably retained in said tip such that said application ball may partly be exposed from the front edge of said tip, spring means for resiliently forcing said application ball in abutting relation against the caulked front edge of said tip, and cap means for covering said tip, said cap means having an inner barrel with an inner circumference in intimate contact with the outer circumference of said neck so as to seal said tip, said cap means having a valve member provided with pushing means, disposed in the inner barrel thereof, for:

pushing said application ball against the force of said spring means so as to retract said application ball from the caulked front edge of said tip during engagement of said cap means with said neck when said cap means is applied in covering relation to said tip, and disengaging from the application ball to allow the application ball to resume contact with the caulked front edge of said tip as a result of said spring means when said cap means is fully engaged with said neck.

2. The applicator according to claim 1, wherein said valve member is made of a highly flexible material and has a cylindrical form with an inward flange formed therein which defines a center bore thereof, said inward flange forming said pushing means such that said application ball retracts from the caulked front edge of said tip when said application ball abuts against said inward flange during engagement of said cap means with said neck when said cap means is applied in covering relation to said tip, and such that said application ball enters into the center bore of said inward flange to resume contact with the caulked front edge of said tip when said cap means is fully engaged with said neck.

3. The applicator according to claim 1, wherein said valve member is made of a highly flexible material and has a cylindrical form with a tongue which is cut out therefrom so as to protrude inwardly of said cylindrical form, such that said application ball retracts from said caulked front edge of said tip when said application ball abuts against said tongue during engagement of said cap means with said neck when said cap means is applied in covering relation to said tip, and such that said application ball becomes disengaged with said tonque so as to resume contact with said caulked front edge of said tip when said cap means is fully engaged with said neck.

* * * * *